United States Patent [19]

Mikhail

[11] Patent Number: 5,040,746

[45] Date of Patent: Aug. 20, 1991

[54] FINNED PROJECTILE WITH SUPPLEMENTARY FINS

[75] Inventor: Ameer G. Mikhail, Bel Air, Md.

[73] Assignee: The United States of America as represented by the Secretary of the Army, Washington, D.C.

[21] Appl. No.: 567,028

[22] Filed: Aug. 14, 1990

[51] Int. Cl.[5] ..... F42B 10/18

[52] U.S. Cl. ..... 244/3.27; 244/3.3

[58] Field of Search ..... 244/3.26, 3.27, 3.28, 244/3.29, 3.3, 46, 49

[56] References Cited

U.S. PATENT DOCUMENTS

| | | | |
|---|---|---|---|
| 1,276,892 | 8/1918 | Fender | 244/3.27 |
| 3,165,281 | 1/1965 | Gohlke | 244/3.28 |
| 3,304,030 | 2/1967 | Weimholt et al. | 244/3.29 |
| 3,633,846 | 1/1972 | Biggs | 244/3.27 |
| 4,209,146 | 1/1980 | Mattson | 244/3.27 |
| 4,440,360 | 4/1984 | Hallstrom | 244/3.28 |
| 4,641,802 | 2/1987 | Zalmon et al. | 244/3.28 |
| 4,667,899 | 5/1987 | Wedertz | 244/49 |

FOREIGN PATENT DOCUMENTS

| | | | |
|---|---|---|---|
| 1199664 | 8/1965 | Fed. Rep. of Germany | 244/3.29 |
| 2608989 | 9/1977 | Fed. Rep. of Germany | 244/3.29 |
| 2635676 | 2/1978 | Fed. Rep. of Germany | 244/3.29 |
| 594514 | 11/1947 | United Kingdom | 244/3.27 |

*Primary Examiner*—Michael J. Carone

*Attorney, Agent, or Firm*—Saul Elbaum; Walter R. Baylor

[57] ABSTRACT

A finned projectile intended to be launched toward a target has a projectile body and a plurality of main fins attached to the projectile body to provide stability thereto in flight. In the preferred embodiment, each main fin includes a supplementary fin movably secured thereto for increasing the overall surface area to further enhance the stability of the projectile after launch. A pin and channel arrangement is used for slidably retaining the supplemental fin and the main fins together for deployment under forces on the projectile during launch and flight thereof. The channel arrangement further includes a portion which angles suddenly to lock the supplementary fin in the deployed position. The preferred embodiment also includes putty disposed within the channel for preventing deployment of the supplementary fin during normal handling of the projectile. The putty is shattered upon initial impact with the pin during launching of the projectile.

4 Claims, 3 Drawing Sheets

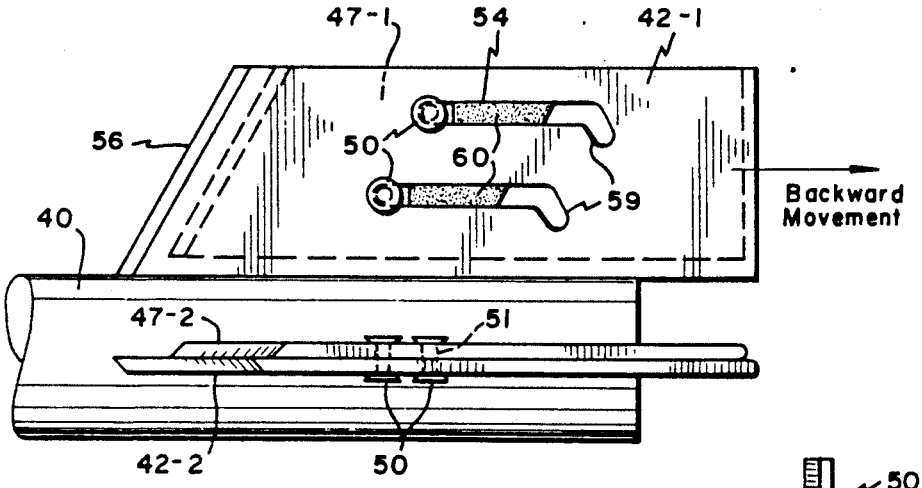
FIG. 3a
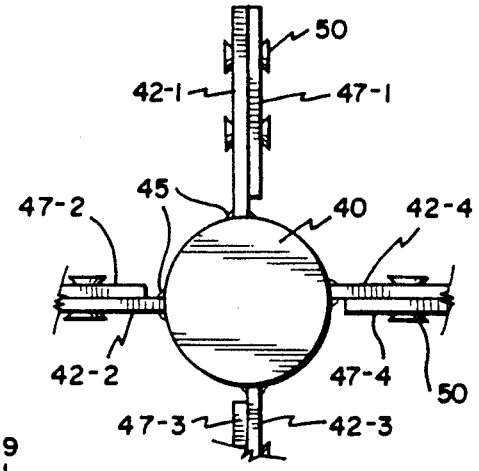
FIG. 3b
FIG. 4
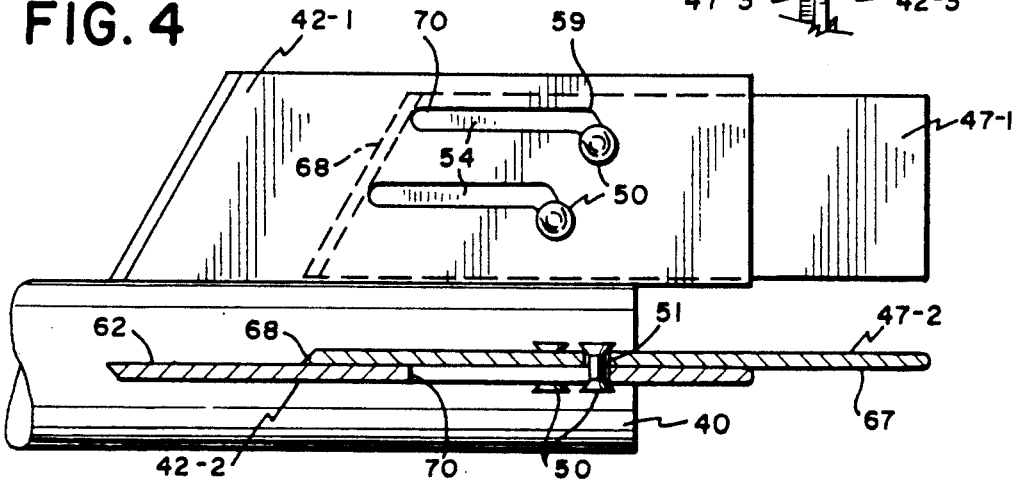
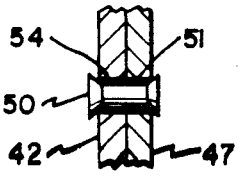
FIG. 7a
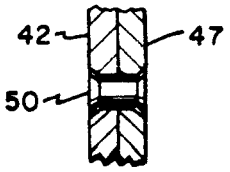
FIG. 7b

FINNED PROJECTILE WITH SUPPLEMENTARY FINS

RIGHTS OF THE GOVERNMENT

The invention described herein may be manufactured, used, and licensed by or for the United States Government for governmental purposes without the payment to me of any royalty thereon.

BACKGROUND OF THE INVENTION

The present invention relates particularly to a fin assembly designed to increase fin surface area for projectiles.

Firing range tests of 60 mm (millimeter) solid fuel ramjet projectiles from a 120 mm gun revealed certain significant deviations from expected trajectory. Among the explanations for such behavior are: damaged fins (e.g., attributable to in-flight metal burning, or to in-bore contact with the propellant granules during the projectile release from its primer case), and insufficient fin normal force required for static stability. In an attempt to solve the problem, the area of each fin 10 (FIG. 1) ahead of the leading edge 12 of the fin was increased, as illustrated by the dashed area 15, to provide an additional normal force, viz. $\Delta_1 F_f$, but the resulting increase in stabilization was found to be insufficient. This undesirable result is attributable to the smaller fin moment arm $x_{1cp}$ (of that additional force for the increased area) relative to the center of gravity (CG) of the finned projectile 17.

It was recognized that the addition of surface area 20 at the trailing edge 22 of fin 10-1 (and of the other fins 10-2, 10-3 and 10-4, the latter being hidden by the body of projectile 17 in FIG. 1), rather than at the leading edge, would be more effective because that solution would serve to produce a larger fin moment arm $x_{2cp}$, and additional normal force $\Delta_2 F_1$. However, such a solution could not be implemented because of the limitation on the distance $\Delta x_f$, owing to projectile packaging constraints.

In part, the packaging constraints are better understood by reference to FIG. 2 as well as to FIG. 1. The projectile 17 is packaged for use in a conventional propellant case assembly. The case assembly includes a pusher disk 30 having a rotating band/obturator 32, and is partly inserted into the propellant charge casing 35. The set of geometrical constraints on the fin design includes the following. The fin height h (FIG. 1) is fixed because the maximum diameter $d_f$ is limited by the bore size of the gun. The fin root chord length cannot be extended beyond the base of the projectile in excess of the length $\Delta x_f$ (FIG. 1), because of projectile packaging considerations for the attachment to the primer case containing the propellant charge. Also, the number of fins of the projectile cannot be increased to exceed four, such as to six as a means to increase the fin surface area, because of a limitation on the number of sabot pieces permitted for positioning the projectile in the gun barrel.

It is a principal object of the present invention to increase the stabilization of finned projectiles during flight, to be able to maintain the trajectory of the projectile.

Another object of the invention is to provide a finned projectile with improved stability, and thereby with the capacity to more accurately follow a desired trajectory, without violating the many practical constraints on size, shape and number of the fins imposed on the projectile.

SUMMARY OF THE INVENTION

The invention arose from the recognition that it would be desirable to increase the existing fin surface area of the finned projectile as a means for stabilizing the projectile in flight, subject to various packaging and propellant charge case spacing constraints on a suitable design. An increase in the fin surface area would increase the normal force produced by the fins, thereby increasing the fin force moment about the center of gravity (CG) of the projectile and, therefor, increasing the pitching motion stability of the projectile.

According to a presently preferred embodiment of the invention, a finned projectile intended to be launched toward a selected target has a projectile body and a plurality of fins attached to the projectile body to provide stability thereto in flight. At least some of the fins constitute main or host fins which include means for in-flight increasing of the surface area thereof to further enhance the stability of the projectile during flight, whereby to maintain the desired trajectory of the projectile toward the selected target. Other means operatively associated with the surface area increasing means are employed to maintain the increased surface area in flight.

In the preferred embodiment, the surface area increasing means includes a supplemental fin secured to a respective one of each of the main fins, and means for deploying the supplemental fin to a displaced position relative to its main fin including a pin and channel arrangement for slidably retaining the supplemental fin and associated main fin together for deployment under forces on the projectile during launching and flight thereof. The main and supplemental fin assembly further includes means for preventing deployment of the supplemental fin during normal handling of the projectile, and means for locking the supplemental fin in a fully deployed position relative to its associated main fin.

Therefore, it is still another object of the present invention to provide a finned projectile with increased fin surface area and to maintain that increased surface area while the projectile is in flight.

Yet another object is to provide a finned projectile with a deployable fin structure which does not interfere with the projectile packaging in its propellant charge casing.

BRIEF DESCRIPTION OF THE DRAWINGS

The above and still further objects, features, and attendant advantages of the invention will be better understood and appreciated from a consideration of the following detailed description of a presently preferred embodiment, taken in conjunction with the accompanying drawings in which:

FIGS. 3*a* and 3*b* are a side view, partly in section, and an end view, respectively, of a finned projectile with supplementary fins according to a presently preferred embodiment of the invention;

FIG. 4 is a partial side view of the projectile body and a main fin/supplemental fin assembly according to the invention, showing the supplemental fin in its fully deployed position during flight of the projectile;

FIGS. 7*a* and 7*b* are fragmentary section views of the fin assembly using different fastener embodiments.

DETAILED DESCRIPTION OF THE PREFERRED EMBODIMENT

Figure 1:
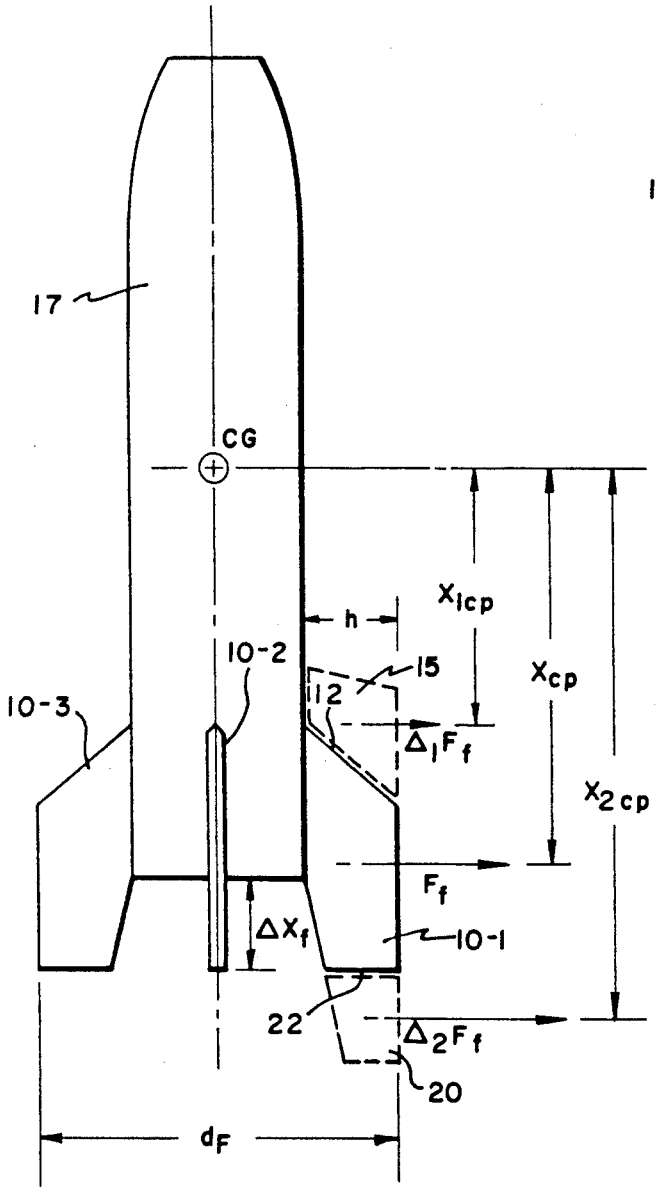
FIG. 1 PRIOR ART
FIG. 1 is a side view of the general configuration of a prior art finned projectile, described above.
Figure 2:
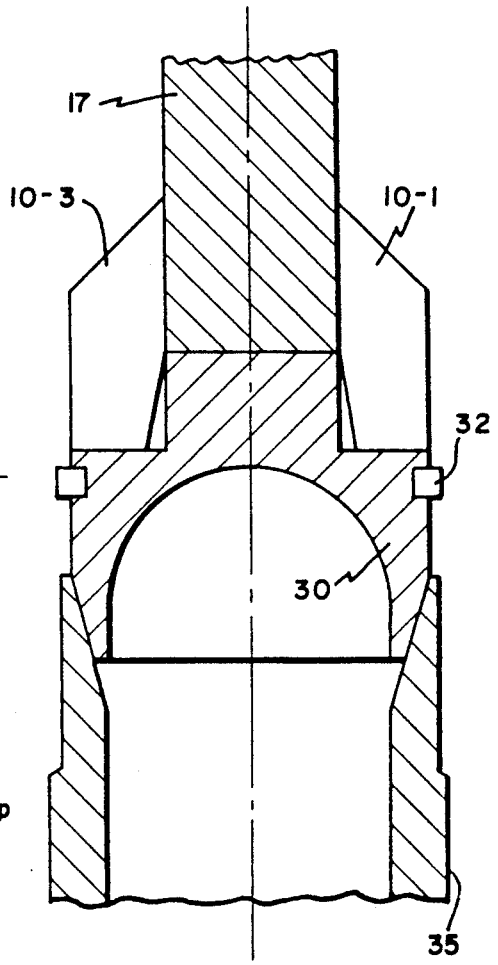
FIG. 2 PRIOR ART
FIG. 2 is a side section view of a portion of the prior art finned projectile of FIG. 1 in a conventional assembly including pusher disk and propellant charge casing, described above.

Referring now to FIGS. 3*a* and 3*b* of the drawings, a presently preferred embodiment of a finned projectile according to the invention is illustrated therein. The projectile body 40 is provided with four main fins 42-1, 42-2, 42-3 and 42-4. Only two of these four fins are shown in FIG. 3*a* for the sake of simplicity and clarity, but it will be understood that all four are constructed in the same fashion. The main fins are either welded to the projectile body 40 or machined with the body from a single piece of metal, in a conventional manner. In either case, small fillets 45 (FIG. 3*b*) may exist at either side of the point of attachment of the fin with the body.

Supplemental fins 47-1, 47-2, 47-3 and 47-4 are mounted on one side of the main fins 42-1, 42-2, 42-3 and 42-4, respectively, with pins or rivets 50 holding the two fin parts of each such assembly together. These pins pass through slightly larger holes 51 in the supplemental fins 47 and through long slotted channels 54 in the main fins 42 (see, also, FIGS. 5*a* and 5*b*, and 6*a* and 6*b*). The channels have parallel sides which are spaced apart by a distance larger than the pin shaft diameter, sufficient to accommodate easy sliding of the pins 50 in the slots 54, and the pins are held captive but slidable in the channels by virtue of the larger heads at either end thereof.

The pins 50, holes 51, and channels 54 of each pair thereof in a main fin/supplemental fin assembly are preferably identical in their respective dimensions, but are offset (shifted) from one another according to the angle of the leading edge 56 of the main fin 42 as shown in FIG. 3*a*. Each of the parallel channels has an end portion 59 which is angled downwardly and rearwardly relative to the longer portion of the channel 54 and the projectile body 40. The end portion 59 serves to capture and lock the respective pin 50 in place after the supplemental fin 47 is forced backward along its respective channel upon launch, and ultimately into its fully deployed position during flight of the projectile, as shown in FIG. 4. In this way, the latter fin is maintained in the fully deployed position, being prevented from forward movement to the original or any intermediate position after the projectile is launched.

Preferably, each of the slotted channels in the main fins is filled initially with a putty material 60 (FIG. 3*a*) having the following properties. The putty is selected to be sufficiently pliable in its original state to bond easily to the metal surfaces of the fins, both main and supplemental in the region of the channel, and harden up quickly to be sufficiently firm so that it does not yield easily to pressure, whereby to assure its retention in the channel and to prevent the supplemental fin from sliding during handling, transportation, and storage of the projectile. Further, the putty is selected to have the property that, after setting (i.e. hardening), it is sufficiently brittle to shatter into small pieces at impact as the pin moves backward in the channel under the inertia of the supplemental fin as the projectile accelerates during launch. The putty should retain its after-setting properties of hardness and brittleness, so that it does not become excessively harder, softer, more brittle or easily chipped with aging over a considerable period of time, in the range, for example, of from thirty to forty years. This assures that the supplemental fins will be retained in place and yet ready for deployment at launch and during flight of the projectile despite a potentially lengthy period of storage before use in combat. Finally, the putty may be burnable as it is subjected to the intense heat inside the gun tube during launch, but should not emit corrosive gases or other by-products during burning that could damage the inner surface of the gun tube.

A suitable putty material, for example, is Omega CC High Temperature Cement, which is produced by Omega Engineering, Inc. of Stamford, Conn., and is the preferred material for use in the presently preferred embodiment of the invention.

As shown in FIG. 3*a*, the putty 60 is applied to fill the respective slotted channel 54 except for the forward and rearward regions in the immediate vicinity of the respective pin 50 and locking slot 59. The empty space near the pin 50 assures that there will be an initial impact of the pin on the putty to cause shattering of the latter during launching of the projectile. The empty space at the inclined locking slot 59 avoids the prospect that putty residuals might enter the locking slot in sufficient quantity to prevent the pin from sliding into and assuming a locked condition within the locking slot both at the launch instant and later during flight.

Notwithstanding the preferred use of such putty material, the invention is not limited to such use. It will be apparent to those skilled in the mechanical arts that other means, to prevent unwanted sliding of the supplemental fins except during launch and in flight of the projectile while assuming the fully deployed and locked position, may be utilized in place of the putty. For example, one or more springs or other mechanical devices (not shown) may be employed for such purpose.

Upon launching of the finned projectile, the supplementary fins 47 commence movement rearwardly of the projectile body 40 under the inertial force attributable to launch acceleration. As the projectile emerges from the gun tube, the aerodynamic force on the leading edge of the supplementary fin causes the latter to complete its movement to a fully deployed and locked position, with the pins 50 finally retained in their respective locking slots 59 (FIG. 4). The supplementary fin 47 is held in its fully deployed and locked position by air resistance that forces the fin to its extreme rearward position. The opposing surfaces 62 and 67 of the main and supplemental fins, respectively, are preferably coated with a non-sticking, non-rusting material, such as Teflon (trademark of DuPont), for example, to prevent the two fins from binding or adhering together during long periods of storage under adverse (e.g., humid) environmental conditions. This coating is also preferred for the pins 50 to prevent rusting and also help easy sliding during deployment.

Referring again to FIG. 4, upon full deployment of the supplementary fins 47 the leading edge 68 of each of them is positioned ahead of the leading point 70 of the respective channels 54 in the main fins 42. This assures that there will be no complete opening through a channel, i.e. that the supplemental fin substantially provides a backing or cover surface 67 for its respective open slot channel, to avoid air leaks through the channels. Such leaks would tend to reduce the efficiency of the configuration by increasing the drag force on the projectile and reducing the normal forces produced by the fins.

Figure 5A:
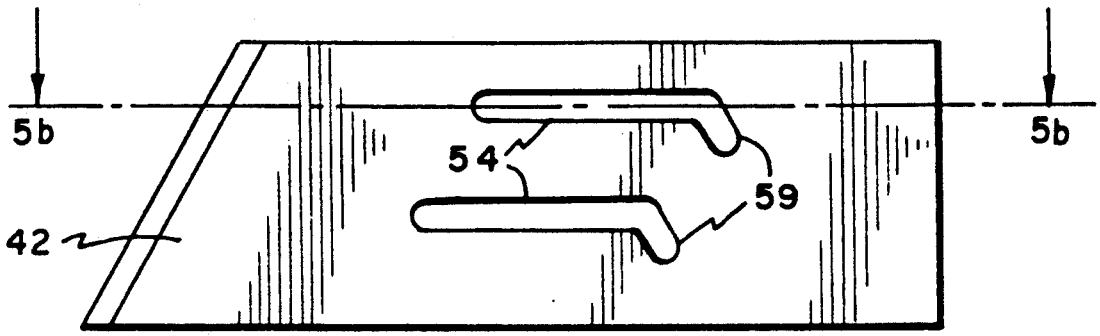
FIGS. 5*a* and 5*b*, and 6*a* and 6*b*, are side and cross-sectional views of the main fin and supplemental fin, respectively, before assembly thereof.
Figure 5B:
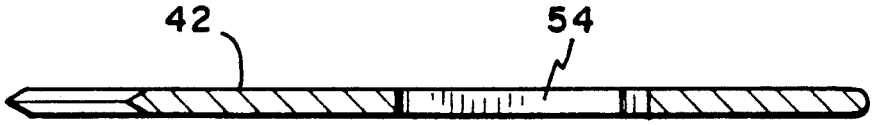
Figure 6A:
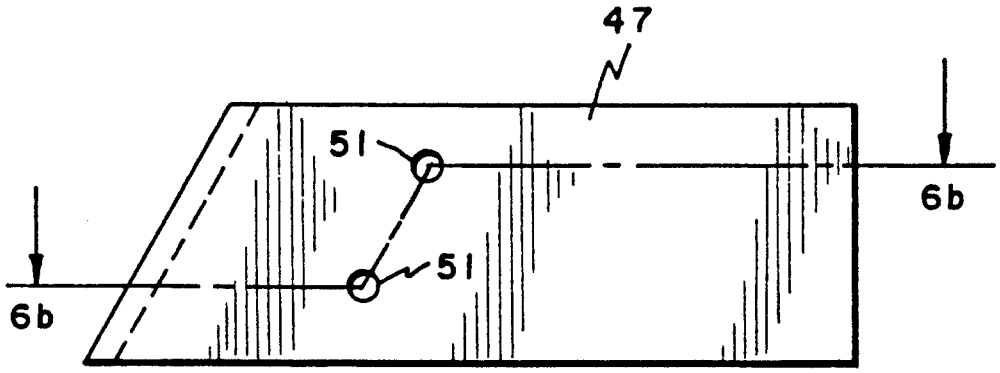
Figure 6B:
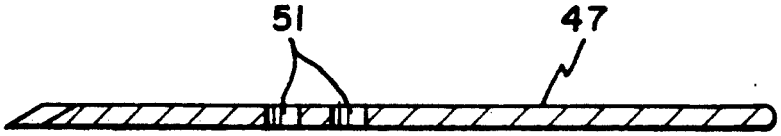

As previously noted, FIGS. 5*a* and *b*, and 6*a* and *b*, illustrate the main fin and the supplemental fin separately and in cross-section, respectively. FIGS. *7a* and *b* show different configurations of the pin, hole and channel arrangement. Referring to all of these Figures, the holes in the supplemental fin are, of course, arranged to match with the channels in the main fin. If the pins are provided with heads that protrude outside the fin surfaces, as shown in FIG. *7a*, the result will be a slightly increased drag on the projectile during flight, and may reduce the fin normal force. Accordingly, the pins may be provided with a head design which, in conjunction with countersunk hole and channel, allows a recessed, non-protruding head assembly, as shown in FIG. *7b*. However, the latter design has the disadvantage of manufacturing difficulties because of the thinness of the fins.

It will thus be seen that the present invention offers significant advantages in in-flight stability, and therefore in maintaining the trajectory toward a desired target, for finned projectiles. The assembly of the host fin and the supplemental fin provides a structure which is nearly as compact as a single fin configuration alone. The assembly and presence of the supplemental fin does not interfere with the projectile packaging or the propellant charge casing. Deployment of the supplemental fin commences with inertia forces at the time of launching of the projectile, and full deployment is achieved, and the supplemental fin is locked in place in that position, by the aerodynamic forces (i.e., drag forces) after the projectile leaves the muzzle of the gun and the pusher disk falls to earth, typically within hundreds of feet from the muzzle. Although the invention has been described with reference to a specific finned projectile, it is useful in finned projectiles generally.

Although a preferred embodiment of the invention has been shown and described herein, variations and modifications may be implemented without departing from the true spirit and scope of the invention, and it is therefore desired that the invention be limited only by the appended claims. For example, any technician familiar with the art can easily change the sliding mechanism in the described preferred embodiment, by placing the slotted channels in the supplemental fins, while placing the pin holes on the main fins.

What is claimed is:

1. A finned projectile for launching against a selected target, comprising a projectile body, a plurality of main fins attached to the projectile body to provide in-flight stability to the projectile, each of said main fins having an associated supplemental fin, a mechanism for initiating a fin sliding movement, retention means holding each main fin and its associated supplemental fin in an assembly for relative movement therebetween to increase the fin surface area of said projectile to further enhance the stability of the projectile during flight, whereby to maintain the desired trajectory of the projectile toward the selected target; said retention means including channel means on the main fins in said assembly, fastener means on said supplemental fin in said assembly for slidably retaining said supplemental fin and its associated main fin together for deployment under forces of inertia on the projectile during launch and flight thereafter, said retention means further including means for preventing deployment of the supplemental fin of said assembly during normal handling, transportation and storage of said projectile; and said deployment preventing means being a putty material.

2. The invention according to claim 1, wherein said retention means further includes means for locking the supplemental fin of said assembly in a fully deployed position relative to the associated main fin of said assembly.

3. The invention according to claim 2, wherein said fin deployment locking means is an inclined channel added to the end of the slotted sliding channel on the main fin, being inclined in a sudden angle to make use of the air resistance and gravitational forces to push and to assist in keeping the deployed supplemental fins from moving back towards their original undeployed positions.

4. The invention according to claim 1, wherein said fin movement initiation mechanism provides an inertia force generated by the sudden acceleration of the projectile body due to the pressure force generated by the detonation of a projectile propellant charge.

* * * * *